US007802440B2

(12) United States Patent
Choi et al.

(10) Patent No.: US 7,802,440 B2
(45) Date of Patent: Sep. 28, 2010

(54) COMPRESSION SYSTEM AND AIR CONDITIONING SYSTEM

(75) Inventors: Song Choi, Seoul (KR); Young Min Kim, Seoul (KR); Baik Young Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 336 days.

(21) Appl. No.: 11/839,630

(22) Filed: Aug. 16, 2007

(65) Prior Publication Data

US 2008/0223055 A1 Sep. 18, 2008

(30) Foreign Application Priority Data

Mar. 13, 2007 (KR) ..... 10-2007-0024404

(51) Int. Cl.
*F25B 31/00* (2006.01)
*F25B 1/10* (2006.01)
*F04B 1/12* (2006.01)
*F04B 1/00* (2006.01)

(52) U.S. Cl. ..... 62/193; 62/510; 417/269; 417/271

(58) Field of Classification Search ..... 62/193, 62/510, 468; 417/245, 269, 271, 254
See application file for complete search history.

(56) References Cited

U.S. PATENT DOCUMENTS 2,500,688 A * 3/1950 Kellie ..... 62/175
4,528,823 A * 7/1985 Mochizuki et al. ..... 62/324.6
5,236,311 A 8/1993 Lindstrom
5,839,886 A * 11/1998 Shaw ..... 417/250
2006/0245953 A1* 11/2006 Lyu ..... 417/415
2007/0074523 A1* 4/2007 Takegami et al. ..... 62/151

FOREIGN PATENT DOCUMENTS

JP 2001-074319 3/2001
JP 2005312272 A * 11/2005
KR 2001064027 A * 7/2001

OTHER PUBLICATIONS

International Search Report and Written Opinion dated Apr. 6, 2009 for Application No. PCT/KR2007/004036, 7 pages.

* cited by examiner

*Primary Examiner*—Chen-Weng Jiang
(74) *Attorney, Agent, or Firm*—Fish & Richardson P.C.

(57) ABSTRACT

A compression system for an air conditioning system includes first and second compressors. The first compressor includes a first compression chamber in which a fluid introduced from an outside of the first compressor is compressed, and a first case defining a first space into which the fluid compressed in the first compression chamber is introduced. The second compressor includes a second case defining a second space into which the fluid compressed in the first compressor is introduced, and a second compression chamber in which the fluid introduced from the second space is compressed. The second compressor operates independently of the first compressor, and a connecting line connects the first and second compressors.

13 Claims, 4 Drawing Sheets

COMPRESSION SYSTEM AND AIR CONDITIONING SYSTEM

This application claims the benefit of Korean Patent Application No. 10-2007-0024404, filed on Mar. 13, 2007, which is hereby incorporated by reference in its entirety.

BACKGROUND

1. Technical Field

This document relates to a compression system capable of efficiently controlling a compression ratio and an air conditioning system using the same.

2. Discussion of the Related Art

Generally, air conditioners perform procedures of compressing, condensing, expanding and evaporating a refrigerant to cool or heat a confined space, such as, for example, a room.

Such air conditioners may be classified into a general single-unit type in which one indoor unit is connected to one outdoor unit, and a multi-unit type in which multiple indoor units are connected to one outdoor unit.

Also, such air conditioners may be classified into a cooling type in which a refrigerant flows only in one direction through a refrigerant cycle, only to supply cold air to a room, and a cooling and heating type in which a refrigerant flows bidirectionally in a selective manner through a refrigerant cycle, to selectively supply cold air or hot air to a room.

Hereinafter, the configuration of a conventional air conditioner will be described briefly.

FIG. 1 is a schematic diagram of an air conditioning system. The refrigerant cycle of the air conditioner includes a compressor 10, a first heat exchanger 30, an expansion valve 40, a second heat exchanger 60, and a 4-way valve 20. These elements of the refrigerant cycle are connected by a connecting line 70 functioning as a passage through which a refrigerant flows.

A refrigerant, which has been changed to a gaseous phase after heat-exchange with indoor air, is introduced into the compressor 10. The gaseous refrigerant is then compressed to a high-temperature and high-pressure state in the compressor 10. Thereafter, the gaseous refrigerant is introduced into the first heat exchanger 30, and is then changed to a liquid phase. As the refrigerant is phase-changed in the first heat exchanger 30, it discharges heat.

The liquid refrigerant from the first heat exchanger 30 is expanded while passing through the expansion valve 40, and is then introduced into the second heat exchanger 60. The liquid refrigerant is then changed to a gaseous phase in the second heat exchanger 60. As the refrigerant is phase-changed in the second heat exchanger 60, it absorbs heat from the outside of the second heat exchanger 60, thereby cooling the room. When it is desired to heat the room, this can be achieved by changing the flow direction of the refrigerant, using the 4-way valve 20, such that the refrigerant cycle operates in reverse.

SUMMARY

In one general aspect, a compression system is capable of efficiently controlling a compression ratio. The compression system may be employed in an air conditioning system. The compression system may be configured to equally supply oil to a plurality of compressors.

In another general aspect, a compression system includes a first compressor, a second compressor and a fluid connecting line. The first compressor includes a first compression chamber configured to compress a fluid introduced from an outside of the first compressor and a first case defining a first space into which the fluid compressed in the first compression chamber is introduced. The second compressor includes a second case defining a second space into which the fluid from the first space is introduced and a second compression chamber configured to compress the fluid from the second space. The fluid connecting line connects the first space and the second space so that the fluid from the first space flows into the second space through the fluid connecting line.

In another general aspect, a compression system includes a first compressor, a second compressor and an oil connecting line. The first compressor compresses a fluid introduced from an outside of the first compressor. The first compressor contains oil. The second compressor is connected to the first compressor in series and compresses the fluid discharged from the first compressor. The second compressor operates independently of the first compressor and the second compressor contains oil. The oil connecting line connects the first and second compressors so that the oil flows between the first and second compressors.

In yet another general aspect, an air conditioning system includes a compression system configured to compress a refrigerant, a first heat exchanger configured to heat-exchange the refrigerant discharged from the compression system with outdoor air, a phase separator configured to separate the refrigerant discharged from the first heat exchanger into a gaseous refrigerant and a liquid refrigerant, a second heat exchanger configured to heat-exchange the liquid refrigerant discharged from the phase separator with ambient air and a gaseous refrigerant line configured to guide the gaseous refrigerant discharged from the phase separator to the compression system. The refrigerant from the second heat exchanger is supplied to the compression system.

Implementations may include one or more of the following features. For example, the first compression chamber may include a first motor and the second compression chamber may include a second motor. At least one of the first and second motors may operate at a variable rotating speed. The first and second motors may operate independently.

The oil in the first and second compressors may flow through the oil connecting line in accordance with a hydrostatic pressure difference between the oil in the first compressor and the oil in the second compressor. The first compressor may be a high-pressure type compressor and the second compressor may be a low-pressure type compressor.

Additional features and advantage will be apparent from the following description, including the drawings, and the claims.

DETAILED DESCRIPTION

Figure 1:
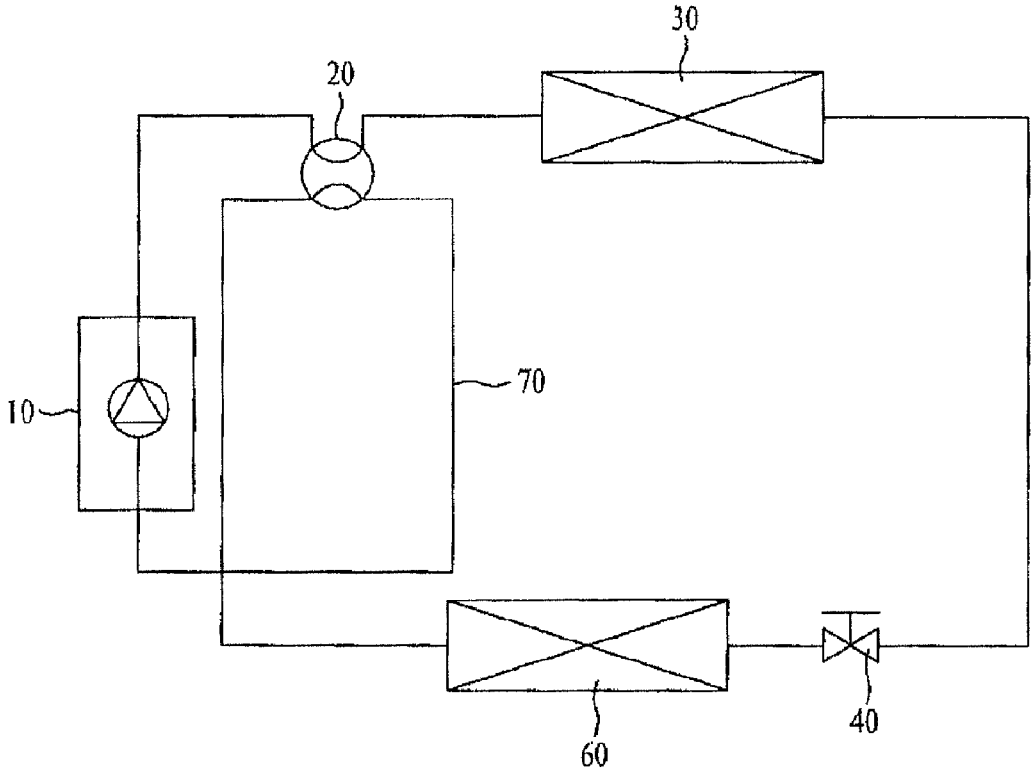
FIG. 1 PRIOR ART
FIG. 1 is a schematic diagram of an air conditioning system.
Figure 2:
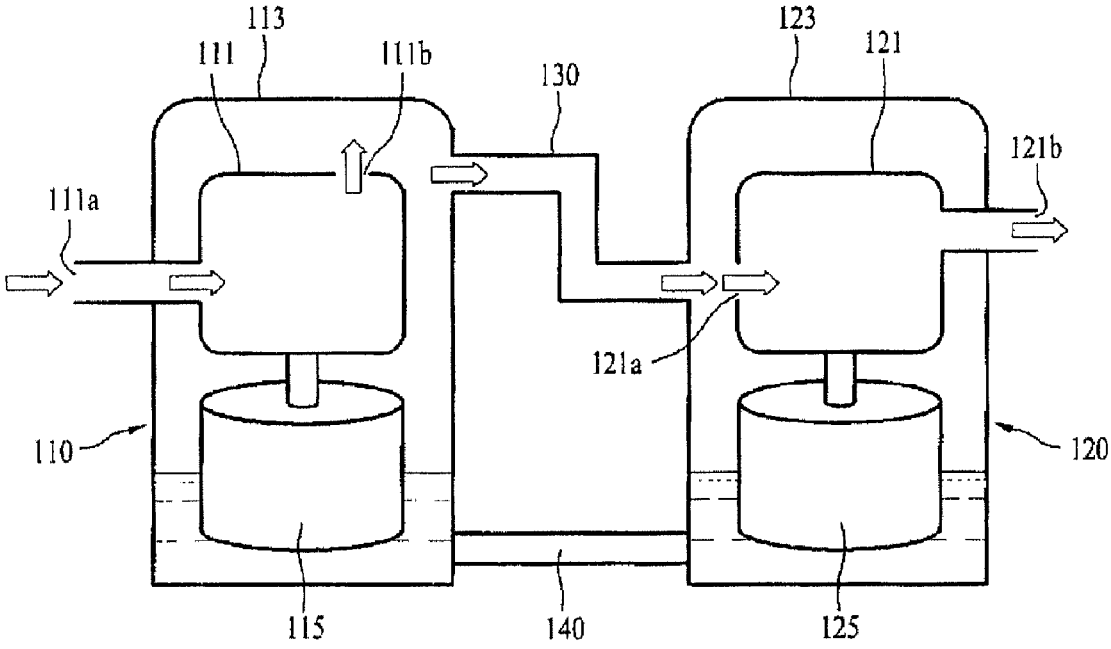
FIG. 2 is a schematic view of a compression system.

FIG. 2 is a schematic view of a compression system. The compression system of FIG. 2 includes a first compressor 110 for compressing a fluid introduced into the compression system from the outside of the compression system, a second compressor 120 for compressing the fluid, which is discharged from the first compressor 110, and a refrigerant connecting line 130 for connecting the first and second compressors 110 and 120.

The first compressor 110 includes a first compression chamber 111 defining a space in which a fluid introduced from the outside is compressed, and a first case 113 defining a first space 112 into which the fluid compressed in the first compression chamber 111 is discharged.

For example, the first case 113 surrounds the first compression chamber 111 such that the first space 112 is defined around the first compression chamber 111. Alternatively, the first compression chamber 111 and first space 112 may be provided separately from each other, and may be connected via a connecting valve.

The first compression chamber 111 forms a pressure lower than that of the first space 112. The first case 113, which defines the first space 112, is filled with a gas having a pressure higher than the pressure of the first compression chamber 111. The compressor of such a type is called a "high-pressure type compressor".

The second compressor 120 includes a second case 123 defining a second space 122 into which the fluid discharged from the first case 113 is introduced, and a second compression chamber 121 in which the fluid introduced from the second space 122 is compressed.

For example, the second case 123 surrounds the second compression chamber 121 such that the second space 122 is defined around the second compression chamber 121. Alternatively, the second compression chamber 121 and second space 122 may also be provided separately from each other, and may be connected via a connecting valve.

The second compression chamber 121 forms a pressure higher than that of the second space 122. The second case 123, which defines the second space 122, is filled with a gas having a pressure lower than the pressure of the second compression chamber 121. The compressor of such a type is called a "low-pressure type compressor".

The compression system also includes a first motor 115 operating to compress the fluid in the first compressor 110, and a second motor 125 operating to compress the fluid in the second compressor 120.

The first and second motors 115 and 125 operate independently. At least one of the first and second motors 115 and 125 operates at a variable rotating speed. Accordingly, the compression ratio of the compression system can be freely controlled by independently controlling the first and second motors 115 and 125.

The refrigerant connecting line 130 connects the first space 112 of the first case 113 and the second space 122 of the second case 123 such that the spaces 112 and 122 communicate.

In detail, the refrigerant connecting line 130 guides the refrigerant compressed in the first compressor 110 to the second compressor 120. An oil connecting line 140 is also provided to equally distribute oil into the first case 113 and the second case 123.

The refrigerant connecting line 130 and oil connecting line 140 connect the first and second compressors 110 and 120 such that the first and second spaces 112 and 122 communicate. In particular, the oil connecting line 140 directly connects the lower portions of the first and second cases 113 and 123.

The internal pressure of the first case 113 and the internal pressure of the second case 123 are substantially equal. This is because the first and second cases 113 and 123 are communicated via the refrigerant connecting line 130.

As a result, oil present in the first case 113 or oil present in the second case 123 flows through the oil connecting line 140 due to a hydrostatic pressure difference between the oil in the first case 113 and the oil in the second case 123.

For example, when the hydrostatic pressure of the oil in the first case 113 is lower than that of the second case 123, oil flows from the second case 123 to the first case 113.

Flow of a fluid in the compression system will now be described.

A fluid, which is introduced into the first compression chamber 111 through an inlet 11*a* provided at one side of the first compression chamber 111, is compressed in the first compression chamber 111, and is then introduced into the first space 112 through an outlet 11*b* of the first compression chamber 111.

The fluid in the first space 112 is then introduced into the second space 122 of the second case 123 via the refrigerant connecting line 130. The fluid in the second space 122 is introduced into the second compression chamber 121 through an inlet 121*a* of the second compression chamber 121. The fluid in the second compression chamber 121 is then discharged to the outside of the compression system through an outlet 121*b* of the second compression chamber 121 after being compressed in the second compression chamber 121.

The above-described compression system may be used in a freezing system or an air conditioning system.

Hereinafter, an air conditioning system, in which the above-described compression system is used, will be described with reference to FIG. 3.

The air conditioning system includes a first heat exchanger 300, a second heat exchanger 600, and expansion valves 410 and 420. Additionally, the air conditioning system includes a phase separator 500 for separating a gaseous refrigerant and a liquid refrigerant from a refrigerant introduced into the phase separator 500.

The air conditioning system further includes a 4-way valve 200 for controlling a refrigerant flow supplied to the first heat exchanger 300, a compressor 100, and the second heat exchanger 600. The compressor 100 includes a first compressor 110 and a second compressor 120.

A refrigerant introducing device is arranged between the phase separator 500 and the compressor 100, to guide the refrigerant to the first and second compressors 110 and 120.

The refrigerant introducing device includes a refrigerant connecting line 130 for supplying the refrigerant from the first compressor 110 and the refrigerant directly from the phase separator 500 to the second compressor 120, a gaseous refrigerant line 710 for connecting the refrigerant connecting line 130 and phase separator 500, and a liquid refrigerant line 720 for connecting the first compressor 110 and phase separator 500.

The refrigerant introducing device may also include a refrigerant control valve 730 arranged in the gaseous refrigerant line 710 to control a flow of the gaseous refrigerant introduced into the second compressor 120.

The expansion valves 410 and 420 include a first expansion valve 410 for primarily expanding the refrigerant from the first heat exchanger 300, and a second expansion valve 420 for expanding the liquid refrigerant separated in the phase separator 500. The refrigerant from the first heat exchanger 300 is in an over-cooled state. This refrigerant is expanded while passing through the first expansion valve 410, so that it is in a state in which a gaseous refrigerant and a liquid refrigerant are mixed. The resultant refrigerant is then introduced into the phase separator 500.

The phase separator 500 is arranged between the first expansion valve 410 and the second expansion valve 420, and functions to separate the gaseous refrigerant and liquid refrigerant from each other. The phase separator 500 is connected to a mixed refrigerant line 750, through which the refrigerant from the first heat exchanger 300 flows. The phase separator 500 is also connected to the gaseous refrigerant line 710, through which the gaseous refrigerant separated in the phase separator 500 flows, and is also connected to the liquid refrigerant line 720, through which the liquid refrigerant separated in the phase separator 500 flows.

The liquid refrigerant separated in the phase separator 500 is expanded while passing through the second expansion valve 420. The liquid refrigerant from the second expansion valve 420 is introduced into the second heat exchanger 600, and is then changed to a gaseous phase in the second heat exchanger 600. The gaseous refrigerant from the second heat exchanger 600 is introduced into the compressor 100, in particular, the first compressor 110, via the 4-way valve 200.

On the other hand, the gaseous refrigerant separated in the phase separator 500 flows through the gaseous refrigerant line 710, and is then mixed with the refrigerant from the first compressor 110 in the refrigerant connecting line 130. The mixed refrigerant from the refrigerant connecting line 130 is again introduced into the second compressor 120, and is then discharged from the compressor 100 after being compressed.

Thus, both the gaseous refrigerant separated in the phase separator 500 and the refrigerant compressed in the first compressor 110 are compressed in the second compressor 120. Because of such a separation of the refrigerant, the compression work load to the compressor 100 is reduced. As the compression work of the compressor 100 is reduced, the operation range of the compressor 100 is widened. Thus, it is possible to use the air conditioning system even in an intensely cold area or in a tropical area.

Hereinafter, a pressure-entropy conversion procedure in the air conditioning system of FIG. 3 will be described with reference to FIGS. 3 and 4.

Figure 3:
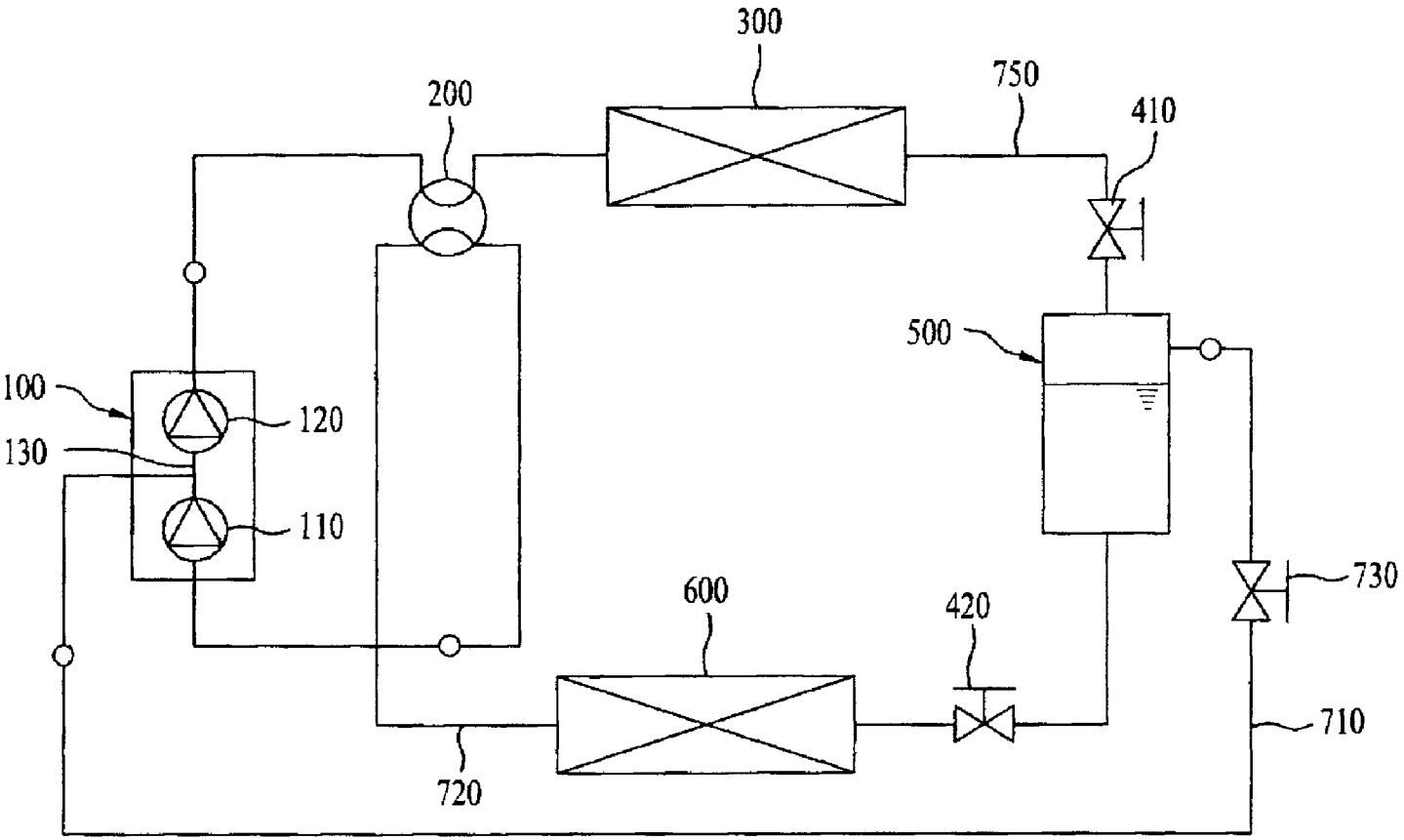
FIG. 3 is a schematic diagram of an air conditioning system using the compression system of FIG. 2.
Figure 4:
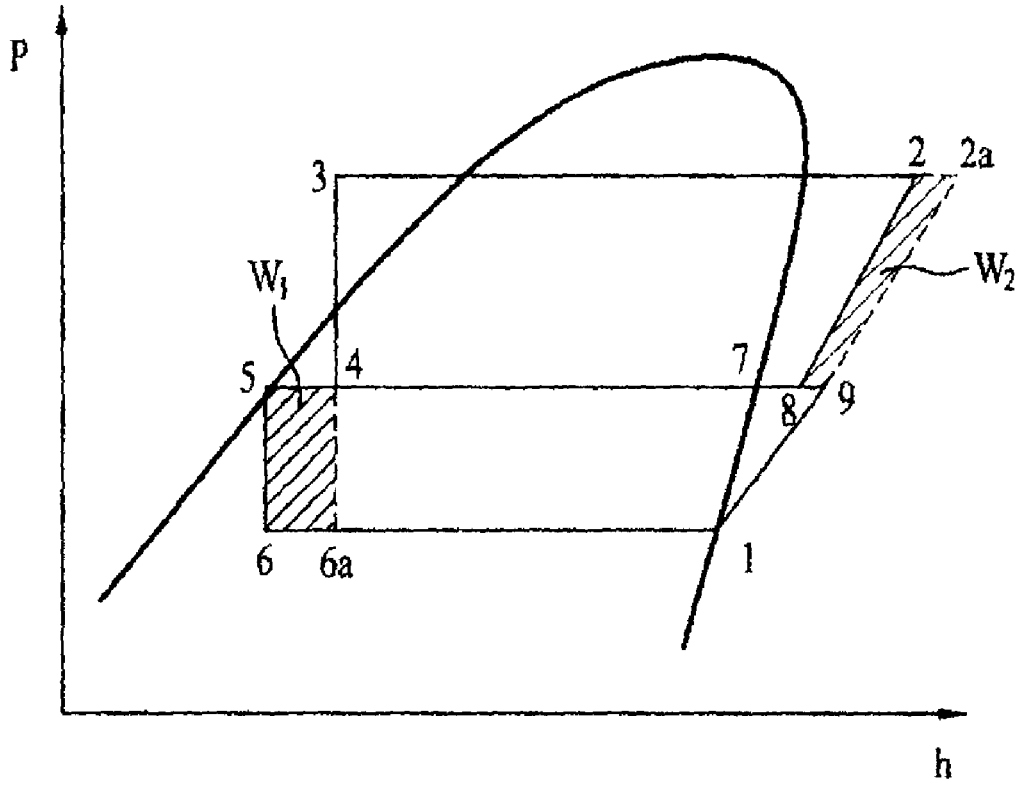
FIG. 4 is a graph depicting the performance of the air conditioning system shown in FIG. 3.

As shown in FIG. 4, the refrigerant cycle in a general air conditioning system includes a compression procedure "1→2a", a condensation procedure "2a→3", an expansion procedure "3→6a", and an evaporation procedure 6a→1". However, the refrigerant cycle in the air conditioning system of FIG. 3 includes a compression procedure "1→9→8→2", a condensation procedure "2→3", an expansion procedure "3→4→5→6", and an evaporation procedure 6→1"

The compression procedure in the air conditioning system of FIG. 3 includes a first compression procedure "1→9" and a second compression procedure "8→2". The first compression procedure represents a compression procedure carried out in the first compressor 110, whereas the second compression procedure represents a compression procedure carried out in the second compressor 120.

The reason why the start point of the second compression procedure shifts from a point "9" to a point "8" is that the gaseous refrigerant separated in the phase separator 500 is introduced into the second compressor 120 via the refrigerant connecting line 130. That is, the gaseous refrigerant separated in the phase separator 500 is introduced into the second compressor 120 after being mixed with the refrigerant from the first compressor 110. Accordingly, the entropy of the refrigerant is reduced.

As a result, the compression work carried out by the compressor 100 is reduced by "W2" because the gaseous refrigerant separated in the phase separator 500 is supplied to the second compressor 120 after being mixed with the refrigerant compressed in the first compressor 110. Thus, the energy efficiency of the system is enhanced.

In the illustrated embodiment, the expansion procedure includes a first expansion procedure "3→4" and a second expansion procedure "5→6". The first expansion procedure represents an expansion procedure carried out in the first expansion valve 410, whereas the second expansion procedure represents an expansion procedure carried out in the second expansion valve 420.

The reason why the start point of the second expansion procedure shifts from a point "4" to a point "5", namely, the reason why a work gain corresponding to "W1" is obtained is that only the gaseous refrigerant of the refrigerant introduced into the phase separator 500 flows through the gaseous refrigerant line 710 after being separated from the introduced refrigerant. That is, since the gaseous refrigerant is separated from the introduced refrigerant by the phase separator 500, the entropy of the refrigerant introduced into the second heat exchanger 600 is reduced. As a result, the heat exchanging efficiency of the second heat exchanger 600 is enhanced, so that the cooling capacity of the air conditioning system is enhanced.

Other implementations are within the scope of the following claims.

What is claimed is:

1. A compression system comprising:

a first compressor including a first compression chamber configured to compress a fluid introduced from an outside of the first compressor, and a first case defining a first space into which the fluid compressed in the first compression chamber is introduced;

a second compressor including a second case defining a second space into which the fluid from the first space is introduced, and a second compression chamber configured to compress the fluid from the second space; and a fluid connecting line connecting the first space and the second space and through which the fluid from the first space flows into the second space, wherein:

the fluid is transferred into the first compression chamber through an inlet of the first compression chamber, and then is transferred into the first space through an outlet of the first compression chamber after being compressed in the first compression chamber, the fluid, after being transferred into the first space, is transferred into the second space of the second case via the refrigerant connecting line, the fluid, after being transferred into the second space of the second case, is transferred into the second compression chamber through an inlet of the second compression chamber, and then is discharged to the outside of the compression system through an outlet of the second compression chamber after being compressed in the second compression chamber, and each of the first and second spaces contains oil therein, the compression system further comprising an oil connecting line connecting the first space and the second space and through which the oil flows between the first space and the second space.

2. The compression system according to claim 1, wherein the first compression chamber includes a first motor and the second compression chamber includes a second motor.

3. The compression system according to claim 2, wherein at least one of the first and second motors operates at a variable rotating speed.

4. The compression system according to claim 2, wherein the first and second motors operate independently.

5. The compression system according to claim 1, wherein the oil flows through the oil connecting line in accordance with a hydrostatic pressure difference between the oil in the first space and the oil in the second space.

6. The compression system of claim 1, wherein the fluid is a refrigerant, and further comprising:

a first heat exchanger configured to heat-exchange the refrigerant discharged from the outlet of the second compression chamber with outdoor air;

a phase separator configured to separate the refrigerant discharged from the first heat exchanger into a gaseous refrigerant and a liquid refrigerant;

a second heat exchanger configured to heat-exchange the liquid refrigerant discharged from the phase separator with ambient air, the refrigerant from the second heat exchanger being supplied to the inlet of the first compression chamber; and a gaseous refrigerant line configured to guide the gaseous refrigerant discharged from the phase separator to the fluid connecting line.

7. An air conditioning system comprising:

a compression system configured to compress a refrigerant and comprising:

a first compressor including a first compression chamber configured to compress the refrigerant introduced from outside of the first compressor, and a first case defining a first space into which the refrigerant compressed in the first compression chamber is introduced; and a second compressor including a second case defining a second space into which the refrigerant from the first space is introduced, and a second compression chamber configured to compress the refrigerant from the second space; and a refrigerant connecting line connecting the first space and the second space and through which the refrigerant from the first space flows into the second space;

a first heat exchanger configured to heat-exchange the refrigerant discharged from the with outdoor air;

a phase separator configured to separate the refrigerant discharged from the first heat exchanger into a gaseous refrigerant and a liquid refrigerant;

a second heat exchanger configured to heat-exchange the liquid refrigerant discharged from the phase separator with ambient air, the refrigerant from the second heat exchanger being supplied to the compression system; and a gaseous refrigerant line configured to guide the gaseous refrigerant discharged from the phase separator to the compression system, wherein:

the refrigerant is transferred into the first compression chamber through an inlet of the first compression chamber, and then is transferred into the first space through an outlet of the first compression chamber after being compressed in the first compression chamber, the refrigerant, after being transferred into the first space, is transferred into the second space of the second case via the refrigerant connecting line, the refrigerant, after being transferred into the second space of the second case, is transferred into the second compression chamber through an inlet of the second compression chamber, and then is discharged to the outside of the compression system through an outlet of the second compression chamber after being compressed in the second compression chamber, and each of the first and second spaces contains oil therein, the compression system further comprising an oil connecting line connecting the first space and the second space and through which the oil flows between the first space and the second space.

8. The air conditioning system according to claim 7, wherein the oil flows through the oil connecting line in accordance with a hydrostatic pressure difference between the oil in the first compressor and the oil in the second compressor.

9. The air conditioning system according to claim 7, wherein the first compressor is a high-pressure type compressor and the second compressor is a low-pressure type compressor.

10. The air conditioning system according to claim 7, wherein the first compressor includes a first motor, and the second compressor includes a second motor.

11. The air conditioning system according to claim 10, wherein at least one of the first and second motors operates at a variable rotating speed.

12. The air conditioning system according to claim 10, wherein the first and second motors operate independently.

13. The air conditioning system according to claim 7, further comprising:

a refrigerant control valve arranged in the gaseous refrigerant line, to control a flow of the gaseous refrigerant.

* * * * *